US006243896B1

(12) United States Patent
Osuna et al.

(10) Patent No.: US 6,243,896 B1
(45) Date of Patent: Jun. 12, 2001

(54) ADJUSTABLE WARMTH DUVET COVER INSERT

(75) Inventors: Karen M. Osuna; Wendy R. Freeman, both of Portland, OR (US)

(73) Assignee: Warming Trends, Inc., Portland, OR (US)

( * ) Notice: Subject to any disclaimer, the term of this patent is extended or adjusted under 35 U.S.C. 154(b) by 0 days.

(21) Appl. No.: 09/435,086

(22) Filed: Nov. 5, 1999

(51) Int. Cl.[7] ..... A47G 9/02
(52) U.S. Cl. ..... 5/502; 5/485; 5/482
(58) Field of Search ..... 5/482, 485, 486, 5/500, 502

(56) References Cited

U.S. PATENT DOCUMENTS

| | | | | |
|---|---|---|---|---|
| 429,894 | * | 6/1890 | Doremus | 5/502 |
| 1,394,061 | * | 10/1921 | Bernstein | 5/690 |
| 1,513,766 | * | 11/1924 | Spooner | 5/502 X |
| 2,248,768 | | 7/1941 | Licht . | |
| 2,263,810 | * | 11/1941 | Leslie et al. | 5/502 |
| 2,399,235 | * | 4/1946 | Leslie | 5/502 |
| 2,505,027 | | 4/1950 | Belsky . | |
| 2,596,547 | * | 5/1952 | Guest | 5/502 |
| 3,241,161 | | 3/1966 | Dashosh . | |
| 3,331,088 | | 7/1967 | Marquette . | |
| 4,005,499 | | 2/1977 | Klein . | |
| 4,631,765 | | 12/1986 | Casey . | |
| 4,748,703 | | 6/1988 | Emi . | |
| 4,839,934 | | 6/1989 | Rojas . | |
| 5,048,975 | | 9/1991 | Holbrook . | |
| 5,070,561 | | 12/1991 | Keidser . | |
| 5,092,008 | * | 3/1992 | Okubo | 5/485 X |
| 5,117,519 | * | 6/1992 | Thomas | 5/500 |
| 5,187,825 | | 2/1993 | Tesch . | |
| 5,195,197 | * | 3/1993 | Gutierrez et al. | 5/482 X |
| 5,566,411 | | 10/1996 | Eiler . | |
| 5,657,497 | * | 8/1997 | Howe | 5/486 X |
| 5,706,535 | * | 1/1998 | Takashima | 5/485 |

FOREIGN PATENT DOCUMENTS

| | | | | |
|---|---|---|---|---|
| 658177 | | 12/1978 | (CH) . | |
| 353162 | * | 5/1922 | (DE) | 5/502 |
| 491524 | | 1/1930 | (DE) . | |
| 159495 | * | 9/1940 | (DE) | 5/502 |
| 705710 | * | 5/1941 | (DE) | 5/502 |
| 3147023 | * | 6/1983 | (DE) | 5/485 |
| 442583 | * | 2/1936 | (GB) | 5/502 |
| 927094 | * | 5/1963 | (GB) | 5/502 |
| 564949 | * | 7/1957 | (IT) | 5/485 |

* cited by examiner

*Primary Examiner*—Terry Lee Melius
*Assistant Examiner*—Robert G. Santos
(74) *Attorney, Agent, or Firm*—Miller Nash LLP

(57) ABSTRACT

An adjustable-warmth bed covering adopted for use inside a duvet cover, either alone or with a comforter that is also inside the duvet cover, and a method for making such a bed covering. Specifically, the bed covering is formed from a base sheet to which are attached fabric strips bounding a plurality of pockets. Each pocket has a closable opening that overlaps the pocket adjacent to it and closer to the head end of the base sheet. Insulator pads may be inserted in the pockets to increase the warmth retention capability of the adjustable-warmth bed covering in the area covered by the pocket. The method involves attaching overlapping fabric strips sequentially to the base sheet and sewing seams parallel to the left and right sides of the base sheet to form pockets.

19 Claims, 3 Drawing Sheets

ADJUSTABLE WARMTH DUVET COVER INSERT

FIELD OF THE INVENTION

This invention relates to bed coverings. More particularly, the invention relates to an adjustable-warmth bed covering adapted for use inside a duvet cover, either alone or with a comforter that is also placed inside the duvet cover, and a method for making such a bed covering.

BACKGROUND OF THE INVENTION

Bed coverings are generally designed to keep a resting person from becoming uncomfortably cool. Active bed coverings, such as electric blankets, accomplish this goal by generating heat. Comforters, blankets, sheets, and other passive bed coverings are generally designed to keep a resting person warm by slowing the loss of body heat to the surroundings. Bed coverings must, however, also allow transmission of a certain amount of body heat to avoid overheating. Most households therefore use lighter-weight bed coverings during warmer weather and different, heavier coverings in cooler weather.

To avoid the need for different coverings for warm and cool weather use. inventors have designed a variety of adjustable-warmth bed coverings. Some adjustable-warmth bed coverings are multiple-zone bed coverings that allow the users to vary the degree of heat retention over different zones of the bed. These multiple-zone bed coverings are particularly useful in allowing variation in heat retention for multiple, simultaneous users or multiple zones on a single user. When two people sleep in a bed, the standard bed coverings that one person finds comfortable may be too hot or cool for the other person. Each person may also find that his or her torso is too warm when a sufficiently thick blanket or other standard bed covering is used to prevent his or her feet, for example, from getting cold. By allowing variation of the heat retention characteristics of different zones of the bed covering, a bed covering can be adjusted to allow each occupant to be comfortable.

U.S. Pat. No. 3,331,088 issued to Marquette (the "Marquette Patent") describes an adjustable-warmth blanket with changeable, detachable top panels that permit the user to achieve the thickness or thinness of the covering desired. The Marquette blanket includes a separate panel that can be attached to the foot portion of the blanket for keeping a person's feet warm. The panels are attached to the blanket using fastening means such as a slide fastener, buttons, eyelets, or laces.

U.S. Pat. No. 5,187,825 issued to Tesch sets forth at least one embodiment of a quilted bed blanket with a plurality of chambers, each individual chamber having an associated opening. Varying degrees of warmth can be obtained by changing the amount of a loose filling material, such as aggregates of spherically wrapped fibers, in each chamber.

U.S. Pat. No. 4,839,934 issued to Rojas (the "Rojas Patent") describes a multiple component comforter quilt providing varying degrees of heat retention in different zones. The Rojas multiple component comforter quilt utilizes pockets into which insulating material can be inserted. Materials of varying insulation qualities can be used with such a pocketed bed covering to provide zonal variation of heat retention characteristics. Specifically, Rojas discloses a container-cover unit containing removable and interchangeable insulator pad units, enclosing heat insulating material such as down. The container-cover can be made of decorative fabrics. An embodiment of the invention described in that patent uses substantially square insulator pads of different heat insulating characteristics to form selective heat insulation zones.

U.S. Pat. No. 2,248,768 issued to Licht (the "Licht Patent") is directed to a pocket form comforter that may include pockets into which forms containing filling materials may be placed. The forms and pockets are shaped in such a manner that the forms are substantially adjacent to each other.

It is notable that none of the adjustable-warmth bed coverings found in the prior art have met with widespread commercial success. All suffer from a number of drawbacks that make their marketing and use impractical. As a result, none are currently marketed in the United States.

One significant drawback of the coverings of the prior art is that they require the user to maintain a substantial inventory of insulating materials of varying heat-retention qualities, only some of which are likely to be in use at any time. This drawback is particularly characteristic of the Rojas and Licht Patents.

Another drawback of the coverings of the prior art is that they are intended to be used as outer coverings. If such coverings were to become commercially available, they would likely be available in only a limited number of fabric designs, making it less likely that a consumer would be able to find an adjustable warmth bed covering that matched the consumer's tastes or home décor.

Yet another drawback of the coverings of the prior art is that their designs generally result in a bed covering having gaps between the different pockets or insulating materials used to provide zonal variation of heat retention characteristics. As a result, the coverings result in "cold spots" that make them less desirable than standard, uniform bed coverings. Although the design described in the Licht Patent avoids gaps by using boxed pocket and insulator form covers, the design suffers from the manufacturing obstacles described below.

Another significant drawback of the coverings of the prior art is that they are difficult or expensive to manufacture. For example, the covering described in the Licht Patent requires both insulator pads and pockets to have boxed comers. As another example, the Rojas Patent describes a covering into which closing flaps or tapes must be incorporated. In addition to increasing manufacturing costs, these requirements make the coverings uneven and uncomfortable in use.

BRIEF SUMMARY OF THE INVENTION

The present invention is an adjustable-warmth duvet cover insert made from a fabric sheet assembly enclosing contiguous, overlapping pockets which may each be filled in use by uniformly sized insulator pads and an improved method for making the adjustable-warmth duvet cover insert. The adjustable-warmth duvet cover insert is formed of a number of generally rectangular fabric strips fastened by seams to a base sheet. The seams bound a plurality of interior pockets formed with openings along one of longer sides of each fabric strip. The open side of each pocket is held closed by a fastener, such as a VELCRO™ fastener. Each fabric strip overlaps the one next to it, eliminating gaps between pads in longitudinally adjacent pockets of the adjustable-warmth duvet cover insert.

Single or multiple insulator pads can be inserted into each pocket to adjust the degree of heat retention in the area of each individual pocket. Because the pads are of a uniform size, any pad can be inserted into any pocket. The use of uniformly sized pads eliminates the need for the user to keep on hand, for example, one thin set of pads for warmer weather and a thicker set of pads for use in cooler weather.

The adjustable-warmth duvet cover insert is constructed of a size to fit inside a duvet cover for one of any of the standard bed sizes (single, double, queen, or king, for example). The overlapping pocket structure results in a product that is smooth and relatively flat, making it more suitable than coverings described in the prior art for use inside a duvet cover. Loops may be incorporated into the four comers of the adjustable-warmth duvet cover insert so that the adjustable-warmth duvet cover insert may be anchored inside the duvet cover to minimize shifting.

Because the adjustable-warmth duvet cover insert is designed for use with a duvet cover, the adjustable-warmth duvet cover insert can readily be used together with a comforter placed inside the duvet cover. The comforter will then provide a substantial basic level of warmth. The insert allows additional insulation to be selectively added or removed zonally. Use of the insert with a comforter reduces the number and thickness of insulating pads likely to be needed to achieve a desired level of warmth, when compared to adjustable-warmth coverings intended for use alone. This combination of the duvet cover, adjustable-warmth insert, and comforter allows the consumer to obtain a variable warmth bed covering while minimizing the expense of and storage space needed for insulation pads. Additionally, the consumer is able to choose the base level of warmth by selecting a comforter with appropriate insulating properties. Finally, the smooth nature of the adjustable-warmth duvet cover insert permits it to be placed on top of or underneath the comforter; when placed underneath, the insulating material in the comforter may better retain its loft.

The present invention also includes an improved method for constructing an adjustable-warmth duvet cover insert. First, matching halves of fasteners are attached to the base sheet and fabric strips that will be used to make the adjustable-warmth duvet insert cover, at each point desired to close the pockets. Fabric strips are then successively attached to the base sheet, beginning with the fabric strip nearest the head end of the adjustable-warmth duvet cover insert and moving to the foot end. Each fabric strip is initially attached using a single seam along the foot edge of each fabric strip.

When the desired number of fabric strips has been attached in this manner, pockets are formed by further securing the fabric strips to the base sheet using seams running substantially parallel to the left and right sides of the base sheet. A seam binding is sewn to the four sides of the base sheet, incorporating loops that can be used to attach the adjustable-warmth duvet cover insert to a duvet cover. Finally, one or more insulator pads are fabricated, sized to fit within the pockets. All pockets and pads are of standard size.

The various objectives, features, and advantages of the invention will be more readily understood upon consideration of the following detailed description of the invention, taken in conjunction with the accompanying drawings.

DETAILED DESCRIPTION OF THE INVENTION

Figure 1:
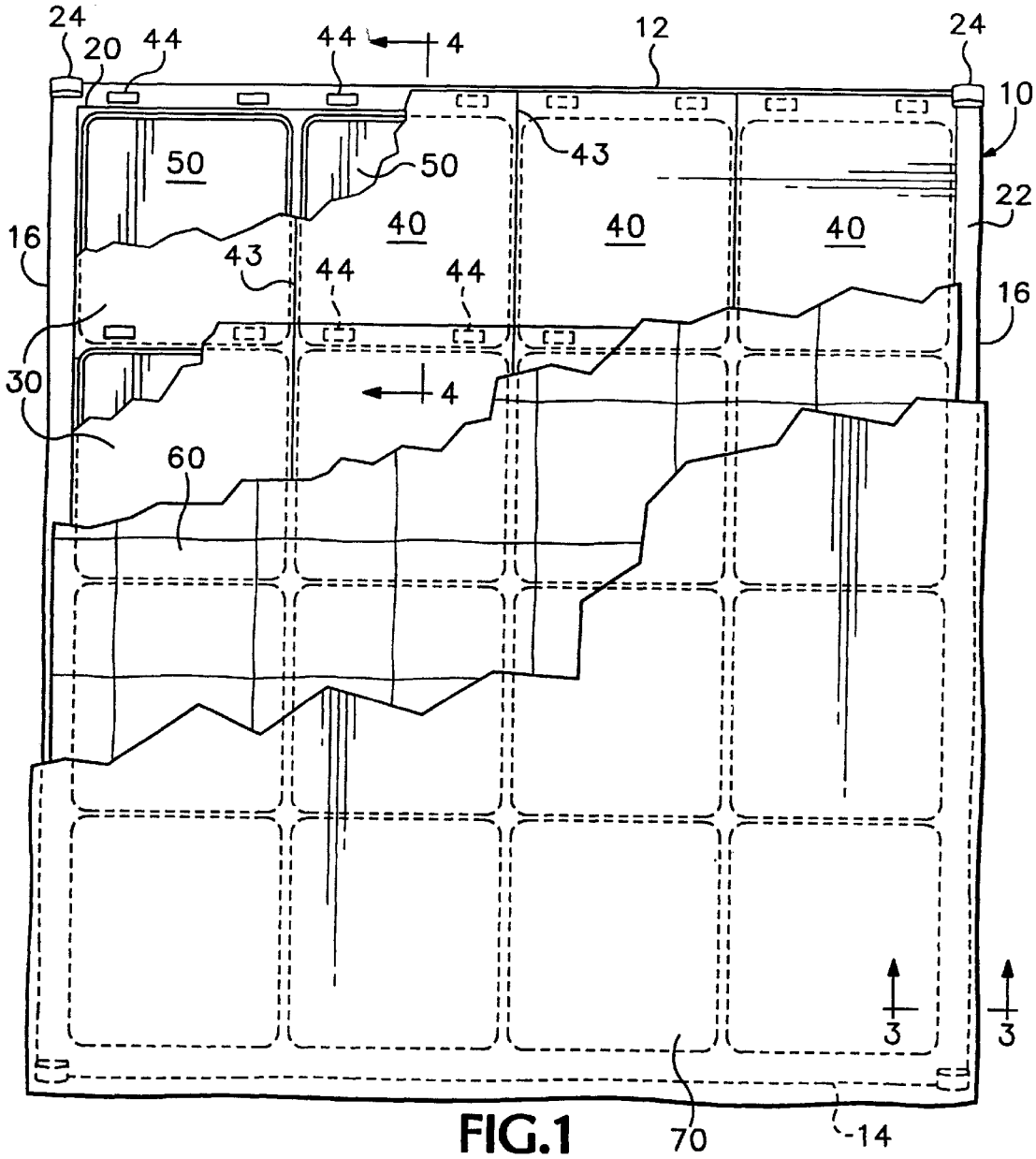
FIG. 1 is a top plan, cutaway view of the adjustable-warmth duvet cover insert and a comforter inside a duvet cover.

Referring to FIG. 1, the adjustable-warmth duvet cover insert of the present invention includes a fabric sheet assembly 10 having contiguous and overlapping pockets 40 thereon, which contiguous pockets 40 may each be filled in use by uniformly sized insulator pads 50. Each adjustable-warmth duvet cover insert 10 can be considered as having a head end 12 and a foot end 14, and left and right sides 16. These designations are for reference purposes only; the adjustable-warmth duvet cover insert can be used in any orientation.

Figure 2:
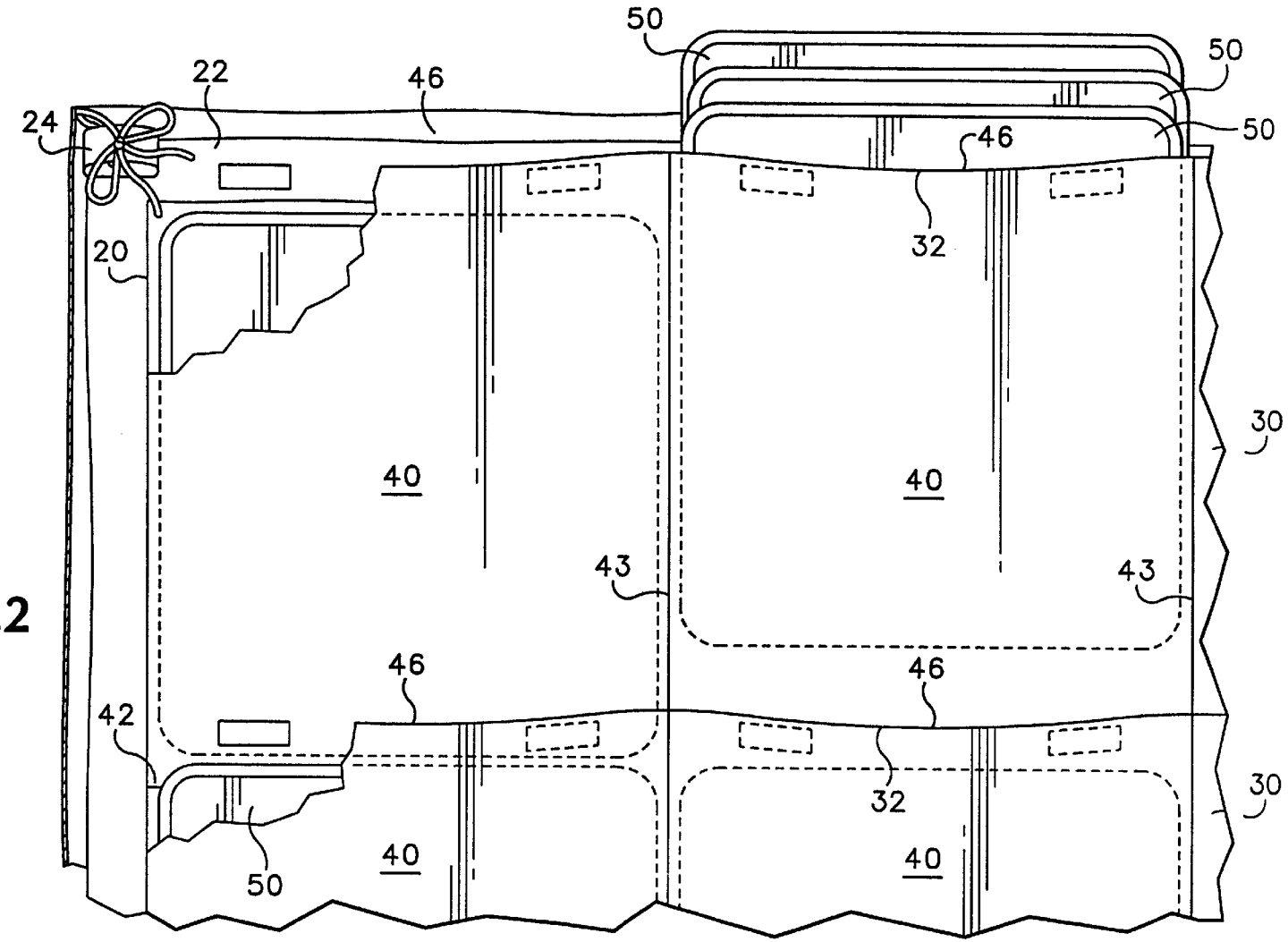
FIG. 2 is an enlarged top plan, cutaway view of a portion of the adjustable-warmth duvet cover insert, showing multiple insulator pads partially inserted into a pocket.
Figure 5:
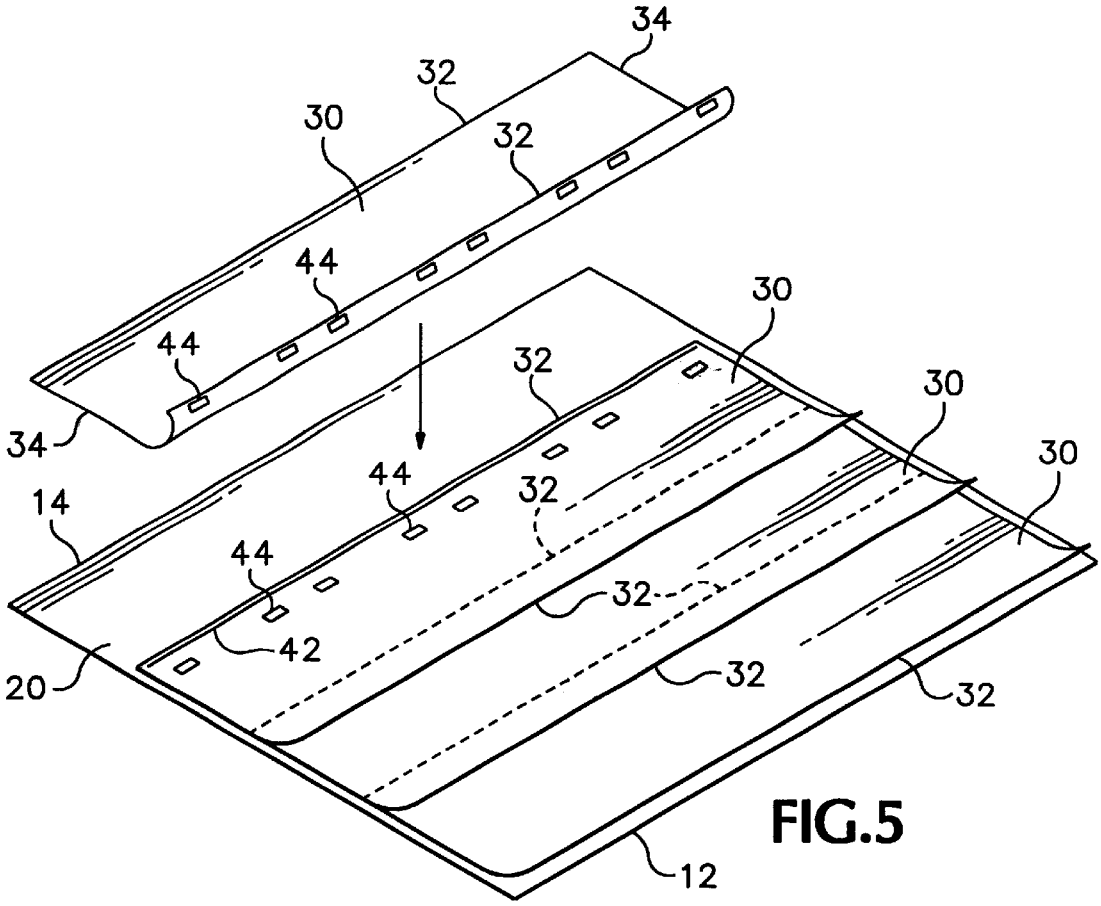
FIG. 5 is a schematic view of the adjustable-warmth duvet cover insert, showing components during assembly.

The adjustable-warmth duvet cover insert 10 is preferably formed of a number of fabric strips 30, shown in FIGS. 2 and 5, fastened by seams 42 and 43 to a base sheet 20. Preferably, the fabric strips 30 are generally rectangular, having first and second long "length" edges 32 and first and second shorter "width" edges 34, the length edges 32 being opposite one another and the width edges 34 being opposite one another. The length edge 32 closer to the head end 12 of the adjustable-warmth duvet cover insert 10 can be considered the head edge of the fabric strip, and the length edge 32 closer to the foot end 14 of the adjustable-warmth duvet cover insert 10 can be considered the foot edge of the fabric strip 30.

Figure 4:
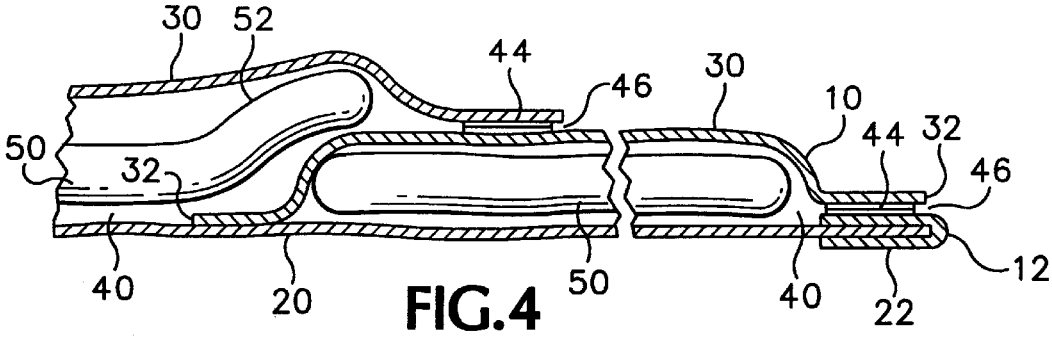
FIG. 4 is a detailed sectional view of the adjustable-warmth duvet cover insert, showing overlap between adjacent pockets and closure arrangement.

Referring to FIGS. 2 and 4, the seams 42 and 43 bound a plurality of interior pockets 40 formed with openings 46 along one of the length edges 32 of each fabric strip 30. Each of the pockets 40 may be filled by one or more insulator pads 50 that can be inserted or removed through an associated opening 46 of the pocket 40.

An overlapping-pocket structure is used to hold the insulator pads 50 in place. Referring again to FIG. 1, moving from the foot end 14 of the adjustable-warmth duvet cover insert 10 to the head end 12, each fabric strip 30 overlaps slightly the fabric strip 30 that is adjacent to it and closer to the head end 12. As shown in FIG. 4, the opening 46 of each pocket 40 is toward the head end 12 of the duvet cover insert 10. At least one fastener 44, such as a hook-and-loop type of fastener, is used to removably attach the fabric strip 30, on the open side of the pocket 40, to the fabric strip 30 that it overlaps, closing the pocket 40 and securing any insulator pads 50 that have been inserted into the pocket 40. The pockets 40 formed by the fabric strip 30 closest to the head end 12 of the adjustable-warmth duvet cover insert 10 are closed using at least one fastener 44 attached to the fabric strip 30 and to the base sheet 20. It will be apparent that other means of closing the pockets could also be used, such as zippers, ties, buttons, or snaps. In addition, flaps of fabric could be used to close the pockets, in place of the overlapping fabric sheet structure described and shown in the drawings.

In a preferred method, the adjustable-warmth duvet cover insert can be fabricated utilizing the following steps.

Referring to FIGS. 4 and 5, one of the separable halves of hook-and-loop fasteners 44 is sewn to the head end 12 of base sheet 20, at each point desired to close the pockets 40 at the head end 12 of the base sheet 20. The other half of each hook-and-loop fastener 44 is sewn to what can be considered the underside of a first fabric strip 30, proximate to the head edge 32 of the fabric strip 30 at positions corresponding to those at which the first half of each hook-and-loop fastener 44 has been sewn to the base sheet 20. One-half of a hook-and-loop fastener 44 is then sewn to what can be considered the upper side of the first fabric strip 30, proximate to the foot edge 32 of the fabric strip 30, at each point desired to close the pockets 40 that will be formed by a second fabric strip 30 adjacent to the first fabric strip and toward the foot end 14 of the base sheet 20. Additional fabric strips 30 are prepared, by attaching the separable halves of hook and loop type fasteners 44 to the fabric strips 30 in similar fashion.

Referring to FIG. 5, the first fabric strip 30 is then positioned on the base sheet 20 so that its length edges 32 are approximately parallel to the head end 12 of the base sheet 20, its head edge 32 is coterminous with the head end 12 of the base sheet 20, and the halves of hook-and-loop type fasteners 44 on the underside of the fabric strip 30 coincide with the halves of hook and loop type fasteners 44 on the base sheet 20, as shown in FIG. 4. The foot edge 32 of the first fabric strip 30 is then sewn to the base sheet 20 preferably using a single continuous seam 42.

The second fabric strip 30 is preferably next positioned on the base sheet so that its length edges 32 are approximately parallel to the head end 12 of the base sheet 20, its head edge 32 overlaps the first fabric strip 30 by at least the width of the fasteners 44, and the corresponding halves of the hook and loop type fasteners on the overlapping portions of the first and second fabric strips coincide. The foot edge 32 of the second fabric strip 30 is then sewn to the base sheet 20 preferably using a single continuous seam 42.

Additional fabric strips 30 may be successively sewn to the base sheet 20 until the desired number of fabric strips 30, preferably substantially covering the base sheet 20, have been attached.

Pockets 40 are preferably then formed by sewing the fabric strips 30 to the base sheet 20 using successive seams 43 running from the foot end 14 to the head end 12 of the base sheet 20 as shown in FIGS. 1 and 2, substantially parallel to the left and right sides 16 of the base sheet 20.

A seam binding 22 may then be sewn to the four sides of the base sheet 20, incorporating loops 24 that can be used to attach the adjustable-warmth duvet cover insert to a duvet cover.

Although the description of the preceding steps refers to attaching the fabric strips and forming pockets by sewing, other methods of attachment and creating seams could be used, such as stapling, tacking, heat-seaming synthetic fabrics, or utilizing a product such as STITCH-WITCHERY™.

Finally, one or more insulator pads 50 are fabricated, using techniques that are generally known to those skilled in the art. The insulator pads 50 are sized to fit within the pockets 40 and be removably insertable into the pockets 40.

The overlapping pocket structure of the present invention reduces or eliminates the gap between pads 50 longitudinally adjacent to each other that would occur if the pockets 40 did not overlap. As a result, an adjustable-warmth duvet cover insert made in accordance with the present invention will have fewer "cold spots" than other adjustable warmth bed coverings and has a flatter, more uniform surface.

The use of overlapping pockets 40 rather than flaps to close the pockets also makes the adjustable-warmth duvet cover insert 10 more uniform in thickness, by eliminating bumps that would result from use of flaps or tape closures. An adjustable-warmth duvet cover insert 10 made in accordance with the present invention is therefore likely to be perceived by the user as "smoother" than other adjustable warmth coverings, and more similar to a standard bed covering in feel.

Another advantage of the invention is that the relatively simple method of fabricating the adjustable-warmth duvet cover insert 10 reduces manufacturing costs, making possible distribution of the adjustable-warmth duvet cover insert 10 at a price that consumers may consider competitive with standard bed coverings.

Referring to FIGS. 2 and 4, the insulator pads 50 are soft, flexible pads having a generally square shape and made of a heat-insulating material, such as cotton batting, down, wool, or a synthetic material, enclosed in a flexible cover 52. Each insulator pad 50 is approximately the size of the pockets 40 in the adjustable-warmth duvet cover insert 10.

Each pocket 40 in the adjustable-warmth duvet cover insert 10 is sufficiently large to allow multiple insulator pads 50 to be stacked and inserted into the pocket 40 to increase the degree of heat retention in the area of the pocket 40, as shown in FIG. 2. By varying the number of insulator pads 50 placed in the pockets 40 of the adjustable-warmth duvet cover insert 10, the heat-retention properties of the insert 10 can be varied over the area of a bed on which it is placed. The users of the insert 10 can place more insulator pads 50 in those pockets 40 where more warmth is desired, and fewer or none in those pockets 40 where increased heat transmission is desired. Varying the number of pads 50 used in different pockets 40 permits not only adjustment of the heat retention characteristics in different zones to suit each of two simultaneous users, but also permits each user to vary the heat retention characteristics of the adjustable-warmth duvet cover insert over different parts of the user's body, as desired. Thus the right-hand portion of a particular adjustable-warmth duvet cover insert 10 may be fitted with a range of heat insulation zones extending from the feet to the chest covering the user lying under the right side of the adjustable-warmth duvet cover insert 10, while the left hand side of the same adjustable-warmth duvet cover insert 10 may be configured with a completely different range of heat insulation zones extending from the foot to the head section. Since all insulator pads 50 are readily replaced and are uniformly sized, the location of insulator pads 50 may be changed at will to easily determine the optimum characteristics for a particular user and for particular times of year.

An important aspect of the present invention is the use of insulator pads 50 having uniform insulating properties and a uniform thickness substantially less than the maximum thickness that could be accommodated by the pockets 40. In one preferred embodiment, the pads 50 are of a uniform square shape, so that any pad 50 can be inserted into any pocket 40. The use of stackable, uniformly sized pads 50 eliminates the need for the user to keep on hand, for example, one thin set of insulator pads for warmer weather and a thicker set of pads for use in cooler weather. This aspect of the invention also allows a greater variation in the degree of warmth retention that can be achieved with a given set of pads.

Figure 3:
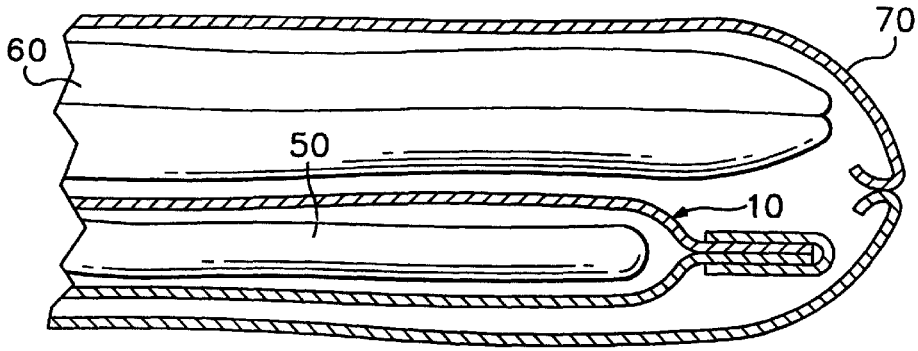
FIG. 3 is a cross-sectional view of a duvet cover, comforter, and the adjustable-warmth duvet cover insert.

Referring to FIGS. 1 and 3, the adjustable-warmth duvet cover insert 10 is preferably adapted for use inside a duvet cover 70. Unlike other pocketed or variable warmth bed coverings disclosed in the prior art, the preferred embodiment of the present invention has no design printed on the base sheet 20 or fabric strips 30 used to make up the adjustable-warmth duvet cover insert. The omission of a design reduces fabrication costs, since white or solid color fabric costs less, in general, than fabric bearing designs and because use of a solid color eliminates the need to align patterns when attaching the fabric strips 30 to the base sheet 20. Use of a single color permits the manufacturer to source and stock one basic fabric, permitting the purchase of that fabric in larger quantities at potentially higher discounts.

FIG. 2 shows loops 24 which are attached to each of the four corners of the adjustable-warmth duvet cover insert 10. Some duvet covers provide ties in each of their four interior corners, to allow a comforter to be attached to the interior of the duvet cover. The loops 24 on the adjustable-warmth duvet cover insert 10 permit the user to easily attach the adjustable-warmth duvet cover insert 10 to the duvet cover 70, anchoring it to prevent bunching or shifting. As an alternative to the loops 24, ties or rings can be incorporated into the corners of the adjustable-warmth duvet cover insert 10, through which the ties of the duvet cover 70 could be anchored.

The loops 24 also permit the adjustable-warmth duvet cover insert 10 to be attached to a comforter if the comforter has ties or other anchoring devices at its corners.

As shown in FIGS. 1 and 3, the adjustable-warmth duvet cover insert 10 may be adapted for use with a comforter 60 inside a duvet cover 70. The adjustable-warmth duvet cover insert 10 may be made of bedsheet weight fabric, rather than blanket material. Use of lighter-weight fabric minimizes heat retention that may not be desired by the user in areas where no insulator pads are utilized. Use of lighter-weight fabric also allows the user to achieve a base level of heat retention from a comforter, and add zones of additional warmth by placing insulating pads 50 in only a few of the pockets 40, for example those covering the user's feet. Adaptation of the adjustable-warmth duvet cover insert 10 for use in this manner gives it a number of advantages not found in other pocketed bed coverings. Use of the adjustable-warmth duvet cover insert 10 with a comforter 60 reduces (in some cases dramatically) the number of insulator pads 50 that most users would need to purchase. For example, if one of two users sharing a bed is usually comfortable with a comforter, and the other consistently has cold feet, two or perhaps four pads 50, placed over the feet of the user who was cold, would be all that were needed to make the couple comfortable.

Use of the adjustable-warmth duvet cover insert 10 with a comforter 60 permits the user to choose a base level of warmth by selecting a comforter 60 with appropriate insulating properties. A user in a cool climate might use the adjustable-warmth duvet cover insert 10 with a relatively light comforter 60 while a user in a cold climate could use the same adjustable-warmth duvet cover insert 10 with a much heavier comforter 60 to achieve the desired degree of baseline warmth.

Because the overlapping pocket structure of the adjustable-warmth duvet cover insert 10 results in a relatively smooth, flat, and uniform bed covering, it is more suitable than coverings described in the prior art for use inside a duvet cover 70. The smooth, flat, and uniform nature of the adjustable-warmth duvet cover insert 10 allows the user to elect to place the adjustable-warmth duvet cover insert 10 over or under the comforter 60 with which it is used. If the adjustable-warmth duvet cover insert 10 is placed underneath the comforter 60, the insulating material of the comforter 60 will better retain its loft and insulating characteristics, particularly if the comforter 60 is filled with down.

In addition, adaptation of the adjustable-warmth duvet cover insert 10 for use with a comforter 60 and duvet cover 70 reduces storage requirements. With pocketed bed coverings intended to be used alone, or perhaps as an outer covering over a bedsheet. virtually all insulating qualities are provided by the insulating pads or materials. Because fewer pads 50 are needed for the present invention when used with a comforter 60, the volume of pads required for comfort, and that must be stored when the adjustable-warmth duvet cover insert 10 is not in use, is substantially less than with pocketed bed coverings intended for use alone.

Use of the adjustable-warmth duvet cover insert 10 with a duvet cover 70 overcomes one of the substantial limitations of adjustable bed coverings of the prior art: the limited number of decorative designs likely to be available. Because the decorative design of an ensemble including the adjustable-warmth duvet cover insert 10 and duvet cover 70 is determined by the duvet cover 70, and not the adjustable-warmth duvet cover insert 10, the present invention eliminates any clash between the decorative fabric design on the adjustable-warmth duvet cover insert 10 and the user's décor. The user is also able to choose a variety of fabric types for the duvet cover 70, which can significantly affect the expense of the entire bedding ensemble.

In one preferred embodiment of the adjustable-warmth duvet cover insert 10, the base sheet 20 and fabric strips 30 are white or neutral 100 percent cotton material. In one exemplary embodiment, four fabric strips 30 are sewn to the base sheet 20 to form pockets 40 22.6" wide and 23.375" long, each of which will accommodate up to three insulator pads 50. Each fabric strip 30 forms four pockets 40 for the queen size adjustable-warmth duvet cover insert and five pockets 40 for the king size adjustable-warmth duvet cover insert 10. Each fabric strip 30 overlaps the one next to it and closer to the head end 12 of the adjustable-warmth duvet cover insert 10 by 1.0". Two fasteners 44, such as VELCRO™ patches, are attached for each pocket to the underside of the fabric strip 30 in the area of overlap, and to the corresponding points on the upper side of the fabric strip 30 being overlapped, for the purpose of allowing each pocket 40 to be easily opened and closed for insertion and removal of insulator pads 50. As shown in FIG. 4, a one-half inch wide cotton seam binding 22 is sewn around the outer edge of the base sheet 20. The binding 22 provides both stability and shape retention properties subsequent to washing. The finished size of the queen size adjustable-warmth duvet cover insert 10 is 92" by 91" and of the king size adjustable-warmth duvet cover insert 10 is 92" by 113.5".

In an exemplary embodiment, the covers 52 of the insulator pads 50 are a solid color 100 percent cotton material. The covers enclose cotton batting or other commonly used insulating material, and are stitched to the extent of 0.125" with seam binding about all four sides to form defined edges so as to cause them to find their place inside the adjustable-warmth duvet cover insert 10, to stay in place while in use, and to retain their shape after washing. The stitched edges will prevent the insulator pads 50 from rotating inside the pockets 40 of the adjustable-warmth duvet cover insert 10.

The finished exemplary size of the pads 50, which can be used in either the king or queen size adjustable-warmth duvet cover insert 10, is 22" by 22".

The terms and expressions which have been employed in the foregoing specification are used therein as terms of description and not of limitation, and there is no intention, in the use of such terms and expressions, to exclude equivalents of the features shown and described or portions thereof, it being recognized that the scope of the invention is defined and limited only by the claims which follow.

What is claimed is:

1. An adjustable-warmth duvet cover insert for use with a duvet cover, comprising:

a) a base sheet having head and foot ends;

b) a first fabric strip attached to the base sheet by seams bounding a plurality of pockets, each pocket having a closable opening on that side of the pocket towards the head end of the base sheet;

c) at least one additional fabric strip attached to the base sheet by seams bounding a plurality of pockets, each pocket having a closable opening on that side of the pocket towards the head end of the base sheet, each such additional fabric strip being attached to the base sheet so as to overlap the adjacent fabric strip adjacent to it and toward to the head end of the base sheet; and d) at least one insulating pad of a size smaller than and shape corresponding to the pockets, the pad being insertable into any pocket for the purpose of providing additional warmth retention over that area of the base sheet corresponding to the pocket in which the pad is inserted.

2. The adjustable warmth duvet cover insert of claim 1, in which the pockets are substantially uniform in size.

3. The adjustable warmth duvet cover insert of claim 1, further comprising fasteners for attaching the insert to the duvet cover.

4. The adjustable warmth duvet cover insert of claim 3, the fasteners being cloth loops at each coner of the adjustable warmth duvet cover insert.

5. The adjustable warmth duvet cover insert of claim 3, the fasteners being cloth ties at each comer of the adjustable warmth duvet cover insert.

6. The adjustable warmth duvet cover insert of claim 3, the fasteners being rings at each comer of the adjustable warmth duvet cover insert.

7. The adjustable warmth duvet cover insert of claim 1, each additional fabric strip being removably attached to the overlapped fabric strip in the area of overlap.

8. The adjustable warmth duvet cover insert of claim 7, the extent of overlap being sufficient to cause insulator pads inserted into adjacent pockets formed by two adjacent fabric strips to abut each other without a gap substantially wider than the thickness of the fabric.

9. The adjustable warmth duvet cover insert of claim 1, in which the pockets are sufficiently large to permit a stack of more than one pad to be inserted into each pocket.

10. A bed covering ensemble, comprising:

a) a duvet cover;

b) a comforter sized to fit within the duvet cover, the comforter being insertable within the duvet cover;

c) an adjustable warmth duvet cover insert sized to fit within the duvet cover, insertable within the duvet cover, and having a plurality of closable pockets, the closable pockets being formed by overlapping fabric strips attached to a base sheet having head and foot ends, wherein each pocket has a closeable opening on that side of the pocket towards the head end of the base sheet; and d) at least one insulating pad sized to fit any of the closable pockets of the adjustable warmth duvet cover insert, providing additional warmth retention capability in the area covered by the pocket in which it is inserted.

11. The bed covering ensemble of claim 10, in which the pockets are substantially uniform in size.

12. The bed covering ensemble of claim 10, further comprising fasteners for attaching the insert to the duvet cover.

13. The bed covering ensemble of claim 10, each overlapping fabric strip being removably attached to the overlapped fabric strip in the area of overlap.

14. The bed covering ensemble of claim 13, the extent of overlap being sufficient to cause insulator pads inserted into adjacent pockets formed by two adjacent fabric strips to abut each other without a gap substantially wider than the thickness of the fabric.

15. The bed covering ensemble of claim 10, the pockets being sufficiently large to permit a stack of more than one pad to be inserted into each pocket.

16. A method for making an adjustable warmth duvet cover insert, comprising the steps of:

a) attaching a first fabric strip having head and foot edges to a base sheet having head and foot ends and left and right sides;

b) attaching at least one additional fabric strip having head and foot edges to the base sheet, such additional fabric strip being closer to the foot end of the base sheet than the fabric strip last attached, the attachment being made by attaching the foot edge of the additional fabric strip to the base sheet so that the head edge of the additional fabric strip overlaps the foot edge of the fabric strip last attached; and c) defining a plurality of pockets by attaching each fabric strip to the base sheet using successive pocket-forming seams, each pocket-forming seam being generally parallel to the left and right sides of the base sheet.

17. The method of claim 16, wherein the step of attaching a first fabric strip further includes the step of attaching the foot end of the first fabric strip to the base sheet so that the head edge of the first fabric strip substantially coincides with the head end of the base sheet.

18. The method of claim 16, further compromising the step of attaching fasteners to the base sheet and fabric strips.

19. The method of claim 16, further comprising the step of fabricating at least one insulator pad adapted to fit within the pockets.

* * * * *